US005862238A

United States Patent [19]

Agnew et al.

[11] Patent Number: 5,862,238

[45] **Date of Patent: *Jan. 19, 1999**

[54] HEARING AID HAVING INPUT AND OUTPUT GAIN COMPRESSION CIRCUITS

[75] Inventors: Jeremy A. Agnew, Colorado Springs; Jerry R. Wahl, Woodland Park, both of Colo.

[73] Assignee: Starkey Laboratories, Inc., Minn.

[ * ] Notice: The term of this patent shall not extend beyond the expiration date of Pat. No. 5,822,442.

[21] Appl. No.: 526,807

[22] Filed: Sep. 11, 1995

[51] Int. Cl.[6] ..... H04R 25/00

[52] U.S. Cl. ..... 381/321; 381/108

[58] Field of Search ..... 381/68.2, 68.4, 381/106, 107, 108; 341/139; 330/278, 254, 260, 261; 333/14

[56] References Cited

U.S. PATENT DOCUMENTS

| | | | |
|---|---|---|---|
| 4,471,171 | 9/1984 | Köpke et al. . | |
| 4,475,230 | 10/1984 | Fukuyama et al. . | |
| 4,508,940 | 4/1985 | Steeger | 381/68.4 |
| 4,543,453 | 9/1985 | Brander | 381/68.4 |
| 4,630,302 | 12/1986 | Kryter | 381/68.4 |
| 4,661,981 | 4/1987 | Henrickson et al. . | |
| 4,718,099 | 1/1988 | Hotvet | 381/68.4 |
| 4,731,850 | 3/1988 | Levitt et al. . | |
| 4,791,672 | 12/1988 | Nunley et al. . | |
| 4,792,977 | 12/1988 | Anderson et al. . | |
| 4,868,517 | 9/1989 | Waldhauer et al. . | |
| 4,882,762 | 11/1989 | Waldhauer . | |
| 4,953,216 | 8/1990 | Beer | 381/68.4 |
| 4,989,251 | 1/1991 | Mangold . | |
| 4,996,712 | 2/1991 | Laurence et al. . | |
| 5,046,103 | 9/1991 | Warnaka et al. . | |
| 5,111,506 | 5/1992 | Charpentier et al. . | |
| 5,131,046 | 7/1992 | Killion et al. . | |
| 5,202,927 | 4/1993 | Topholm . | |
| 5,255,320 | 10/1993 | Ribic | 381/68.4 |
| 5,259,033 | 11/1993 | Goodings et al. . | |
| 5,276,739 | 1/1994 | Krokstad et al. . | |
| 5,278,912 | 1/1994 | Waldhauer . | |
| 5,396,560 | 3/1995 | Arcos et al. . | |
| 5,406,633 | 4/1995 | Miller et al. . | |
| 5,488,668 | 1/1996 | Waldhauer | 381/68.4 |
| 5,553,151 | 9/1996 | Goldberg | 381/68.4 |

OTHER PUBLICATIONS

"Understanding Digitally Programmable Hearing Aids" edited by R.E. Sandlin, Chapter 2, pp. 15, 28, and 31 (1994).

"The Sequel Series—a Smart Systems Product" by J. Agnew, Ph.D, Tom Victorian, Jerry Ruzicka and Michael Block, Ph.D., Starkey Technical Report (undated).

*Primary Examiner*—Vivian Chang
*Attorney, Agent, or Firm*—Jay H. Maioli

[57] ABSTRACT

A hearing aid uses multiple compression feedback loops to minimize sound distortion includes a preamplifier network having an input connected to an input receiver, an output, and an automatically adjustable gain. The preamplifier network measures an output signal which is preferably a voltage and automatically adjusts the gain in response to the output signal. The hearing aid also includes an output drive network having an input connected to the preamplifier network output and an output connected to a load, such as a transducer. The output drive network has an automatically adjustable gain which is responsive to a measured signal at the output of the network. A volume control circuit may also be connected between the output of the preamplifier network and the input of the output drive network to permit the person wearing the hearing aid to adjust the output volume.

3 Claims, 8 Drawing Sheets

HEARING AID HAVING INPUT AND OUTPUT GAIN COMPRESSION CIRCUITS

BACKGROUND

1. Field of the Invention

The present invention relates to an apparatus for preventing sound distortion in hearing aids. More particularly, the present invention provides a hearing aid which utilizes gain control circuitry at both a preamplifier stage and an output stage to prevent saturation of input and output amplifiers.

2. Description of the Related Art

Distortion in the hearing aid art is defined as the generation of added undesired sounds in the output signal that are not present in the input signal. It is believed that such distortion, that is, these additional sounds, act as a type of masking noise for speech, both by direct masking of low-level speech cues that fill in the temporal structure of speech sounds, and by degrading important amplitude cues. Peak-clipping has been used as a technique for limiting the amplitude of the output stage of a standard hearing aid, however, the peak-clipping technique often creates distortions in the output stage of the hearing aid circuitry.

For the purposes of sound distortion analysis, a hearing aid can generally be considered to consist of two primary amplifying stages, a preamplifier stage and an output amplifier stage. FIG. 1 shows an exemplary configuration of a two stage hearing aid 10. As seen in FIG. 1, the preamplifier stage 12 of hearing aid 10 includes an amplifier 14 having one input 16 connected to a microphone 18 via coupling capacitor 20 and another input 22 connected to ground. The amplifier 14 has a fixed gain which is set by resistors 24 and 26. The output 28 of the preamplifier stage 12 is connected to a user adjustable volume control circuit 30 having an output 32 connected to the output stage 34 of the hearing aid 10. The volume control circuit 30 has a potentiometer 36 connected between the output 28 of the preamplifier stage 12 and an input 38 of the output stage 34 via coupling capacitor 40. The output stage 30 includes an amplifier 42 having one input 38 connected to the output 32 of the volume control circuit 30. The amplifier 42 has a fixed gain set by resistors 44 and 46 and has an output 48 connected to a transducer, for example, speaker 50.

In the preamplifier stage, the amount of undistorted amplification available is typically limited by the available battery supply voltage. In conventional ear-level hearing aids, the battery supply voltage is typically limited to 1.25 volts available from a zinc-air battery cell. If the input sound level (amplitude) increases dramatically, the resulting amplified signal at the output of the preamplifier stage tries to exceed the available battery voltage and thus the preamplifier saturates and the output signal becomes distorted (that is, it clips).

Various amplifiers, such as class A and class D amplifiers may be employed at the output stage. Such amplifiers are subject to an overload effect when the input sound level reaches certain thresholds. When using class A amplifiers in the output stage, a signal delivered to the output stage 34 from the preamplifier stage 12 increases as the amplitude of the input sound level into the preamplifier stage 12 increases. When the voltage at the output 28 of the preamplifier 12 reaches the limits of the battery supply voltage, no further amplification can take place. If the input sound level at microphone 18 continues to drive the preamplifier, the amplifier will saturate and distortion will occur.

A similar overload effect may also occur when using class D amplifiers in the output stage, though the saturation mechanism is different. Using a class D amplifier, the output stage 34 operates by producing a variable pulse-width modulated signal across the transducer 50, for example, the speaker coil. As either the input sound level or the amount of system amplification is increased, the pulses eventually merge into each other and the output signal reaches saturation, thus causing distortion, for example, in the form of peak-clipping. Typically, for a class D amplifier, distortion begins at about 3 dB below maximum acoustic output.

Peak-clipping may be unintentional, such as when the output amplifier is over driven, or peak-clipping may be intentional, such as when the saturated sound pressure level (SSPL) of a hearing aid is reduced by a peak-clipping circuit.

Saturation distortion that occurs due to over-driving or output clipping in an amplifier should be distinguished from low levels of distortion that can occur inside a hearing aid with low input levels. Saturation distortion occurs when the input level is so high that saturation is reached either in the pre-amplifier stage or in the output stage or in both stages. When this occurs, the waveform becomes highly distorted. Even in instances where a hearing aid is intentionally configured to produce low distortion at low input levels, saturation distortion will occur at some point as the input sound level is increased beyond the capability of the battery, the amplifier stage, and the output stage.

The high distortion effects of saturation can be seen graphically in FIG. 2 for a typical class D peak-clipping hearing aid used in the hearing aid circuit of FIG. 1. The peak acoustic gain of this hearing aid was 35 dB, the peak saturated sound pressure level (SSPL) was 107 dB, and the frequency response matrix slope (difference in acoustic gain between peak and 500 Hz) was 10 dB. As seen in FIG. 2 a plot of the harmonic distortion versus frequency for input sound levels of 60, 70, 80 and 90 dB is provided. These input sound levels correspond to soft speech, conversational speech, loud speech and shouted speech, respectively. The distortion performance graph shows that the level of distortion is low at low input sound levels, for example, 60 dB and 70 dB, and is in the area of 2 or 3 percent. When the input sound level is increased, for example, to 80 dB, the hearing aid goes rapidly into saturation and the level of distortion increases dramatically, with the percentage of distortion peaking at about 50 percent. At an input sound level of 90 dB, the percentage of distortion continues to increase and typically exceeds the 50 percent distortion plateau, especially in the mid-frequencies, for example between 900 Hz and 2000 Hz.

The use of a compression circuit at the preamplifier stage has been shown to slightly reduce the saturation distortion of conventional hearing aids. FIG. 3 illustrates conventional hearing aid circuitry with a compression circuit 52 connected to the preamplifier stage 12, and FIG. 4 is a distortion performance graph for the hearing aid shown in FIG. 3. As seen in FIG. 4, even with a compression circuit at the preamplifier stage, the percentage of distortion is still significantly high when the input sound level increases above the 80 dB level.

Therefore, a need exists for a hearing aid that responds to high as well as low input sound levels to substantially minimize the percentage of distortion in the output signal of the hearing aid so as to provide a person wearing the hearing aid with clear, audible sound.

SUMMARY

The present invention provides a hearing aid which uses independent multiple compression feedback loops to minimize sound distortion. The hearing aid includes a preamplifier network having an input connected to an input receiver, an output, and an automatically adjustable gain. The preamplifier network measures an output signal, which is preferably a voltage, and automatically adjusts the gain in response to the output signal. The hearing aid also includes an output drive network having an input connected to the preamplifier network output and an output connected to a load, such as a transducer. The output drive network has an automatically adjustable gain that is responsive to a measured signal at the output of the network. The hearing aid of the present invention may also include a volume control circuit connected between the output of the preamplifier network and the input of the output drive network. Preferably, the volume control circuit has a variable resistor, such as a potentiometer, connected in a voltage divider configuration. The volume control circuit permits the person wearing the hearing aid to adjust the output volume of the hearing aid.

In the preferred embodiment, the hearing aid preamplifier network includes an amplifier circuit having an adjustable gain and a gain control circuit connected in a feedback loop with the amplifier circuit. This configuration forms a gain compression feedback circuit which automatically adjusts the gain of the amplifier circuit so as to prevent the amplifier circuit from saturating.

The gain control circuit is connected to an output of the amplifier circuit and is configured to automatically adjust the amplifier circuit gain when a voltage on the amplifier circuit output exceeds a predetermined threshold voltage. The predetermined threshold voltage is set to a value below a voltage where the preamplifier network amplifier circuit saturates. Preferably, the predetermined threshold voltage is 7.8 mV(rms) input-referred which typically corresponds to an 85 dB sound pressure level acoustic input with a battery voltage of 1.25 volts.

Similar to the preamplifier network, the output drive network includes an amplifier circuit having an adjustable gain and a gain control circuit connected in a feedback loop with the amplifier circuit. This configuration also forms a gain compression feedback circuit to automatically adjust the gain of the output network amplifier circuit independent of the preamplifier stage, so as to prevent the amplifier circuit from saturating.

The output drive network gain control circuit is connected to an output of the output drive network amplifier circuit and is configured to automatically adjust the output network amplifier circuit gain when a voltage on the amplifier circuit output exceeds a predetermined threshold voltage. The output network predetermined threshold voltage is set to a value which is below a voltage where the output network amplifier circuit saturates. Preferably, the predetermined threshold voltage is 880 mV(rms) output-referred when a class B push-pull amplifier circuit or a class D pulse-width modulated amplifier circuit is utilized in the output drive network.

In an alternative embodiment, a non-distorting circuit for a hearing aid is provided. In this embodiment, the circuit includes a preamplifier stage having a first amplifier circuit with an adjustable gain and a first gain control circuit. The first amplifier circuit has an input connected to a microphone and an output. The first gain control circuit is connected to the output of the preamplifier stage and is responsive to a voltage on the preamplifier stage output such that when the voltage exceeds a predetermined threshold voltage the gain of the first amplifier circuit is adjusted The circuit also includes an output stage having an input connected to the output of the preamplifier stage, and an output connected to a transducer. The output stage has a second amplifier circuit with a fixed gain, and a second gain control circuit. The second gain control circuit is connected to the output of the output stage and the first gain control circuit. The second gain control circuit is responsive to a voltage on the output of the second amplifier circuit, such that when the second amplifier circuit output voltage exceeds a predetermined threshold voltage the second gain control circuit causes the preamplifier stage gain to change. The predetermined threshold voltages for the preamplifier stage and the output stage may be the same or they may differ. These predetermined voltage thresholds are dependent upon the voltage at which the respective stage saturates.

BRIEF DESCRIPTION OF THE DRAWINGS

Preferred embodiments of the invention are described hereinbelow with reference to the drawings wherein.

DETAILED DESCRIPTION

Generally, as described above, the present invention uses multiple compression feedback loops to minimize the sound distortion in hearing aids, especially when the input sound level increases above a predetermined threshold.

As discussed above, signal clipping can occur at the output of the preamplifier stage and at the output of the output stage. The point at which the preamplifier output clips is dependent upon the amplitude of the input signal from the microphone, that is, the input sound level, the preamplifier gain, and the battery voltage. Typically, clipping occurs when the input sound level, also known as the sound pressure level (SPL) reaches about 80 dB. Clipping at the output stage is a function of the input sound level from the microphone, the preamplifier gain, the battery voltage, the level of attenuation provided by the volume control circuit, and the gain of the output stage.

To illustrate, if the volume control circuit is set by the user for minimum attenuation and the input signal from the microphone increases in magnitude over time, the output of the output stage will clip before the preamplifier stage output, because of the gain of the output stage. On the other hand, if the volume control circuit attenuation is adjusted so that the amplitude of the input signal to the output stage is reduced by the same value or a greater value than the gain of the output stage, then the preamplifier stage will clip before the output stage.

To overcome this problem and minimize clipping in the hearing aid, the output of the preamplifier stage and the output of the output stage are individually sensed and controlled through compression. The compression thresholds for both stages are preferably set as high as possible without causing clipping. Typically, a compression ratio of 10:1 is suitable.

Figure 1:
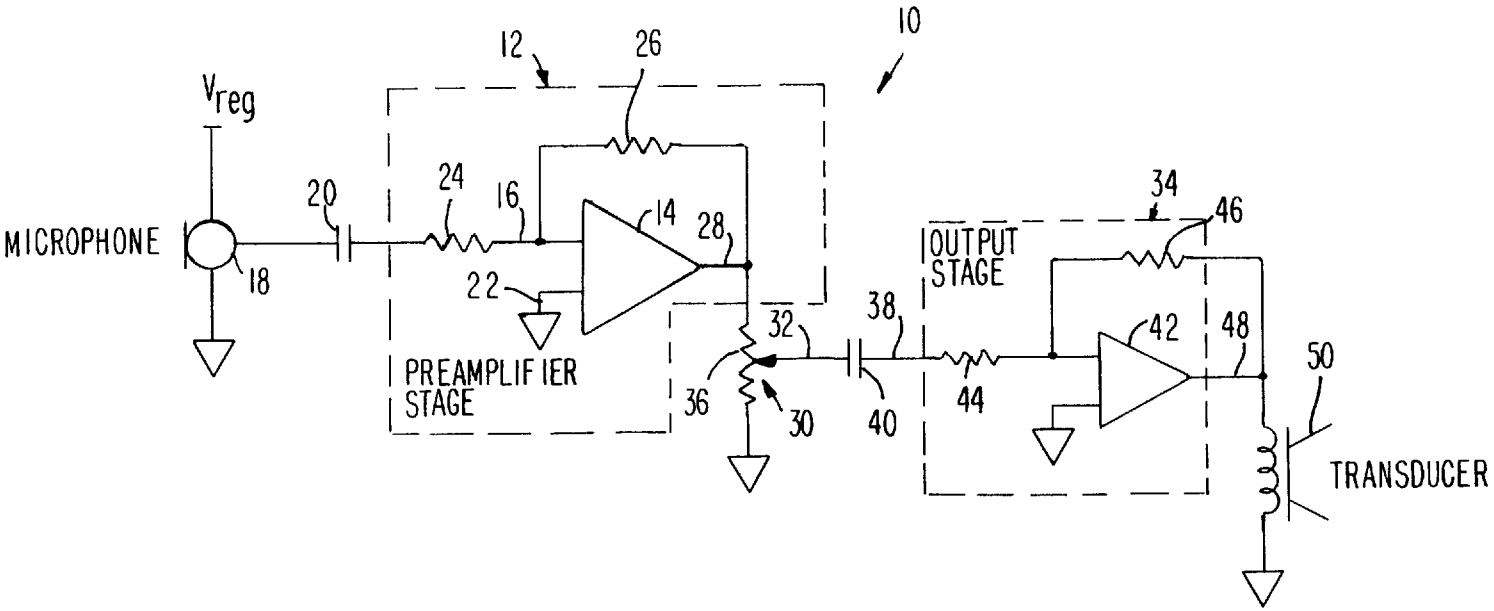
FIG. 1 (PRIOR ART)
FIG. 1 is a circuit diagram for a conventional hearing aid.
Figure 2:
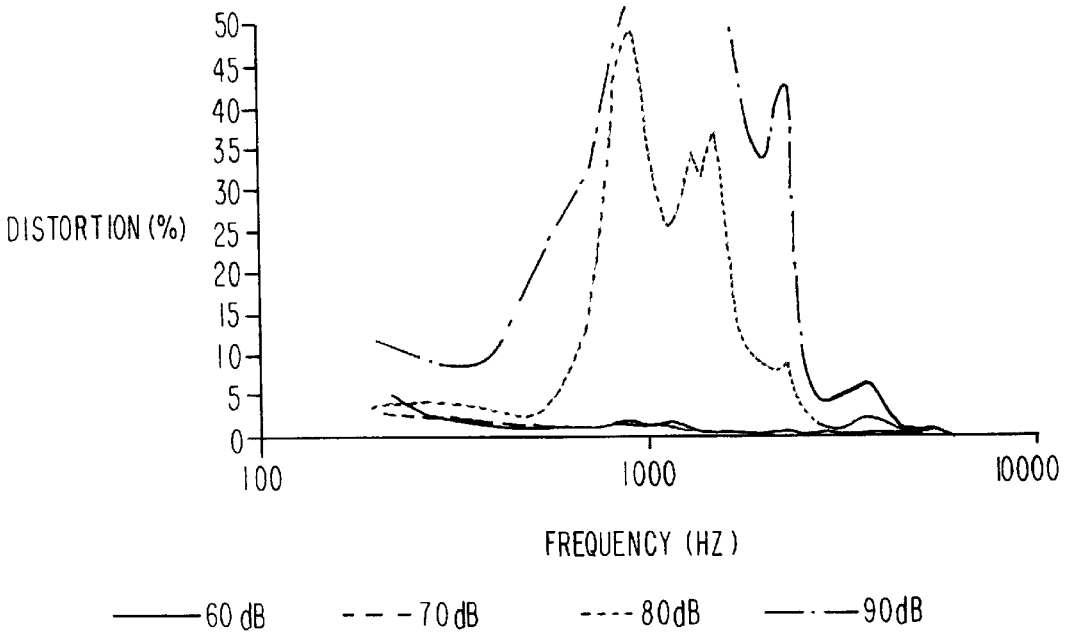
FIG. 2 is a graphical representation of the sound distortion performance characteristics in the conventional hearing aid of FIG. 1 at different input sound levels.
Figure 4:
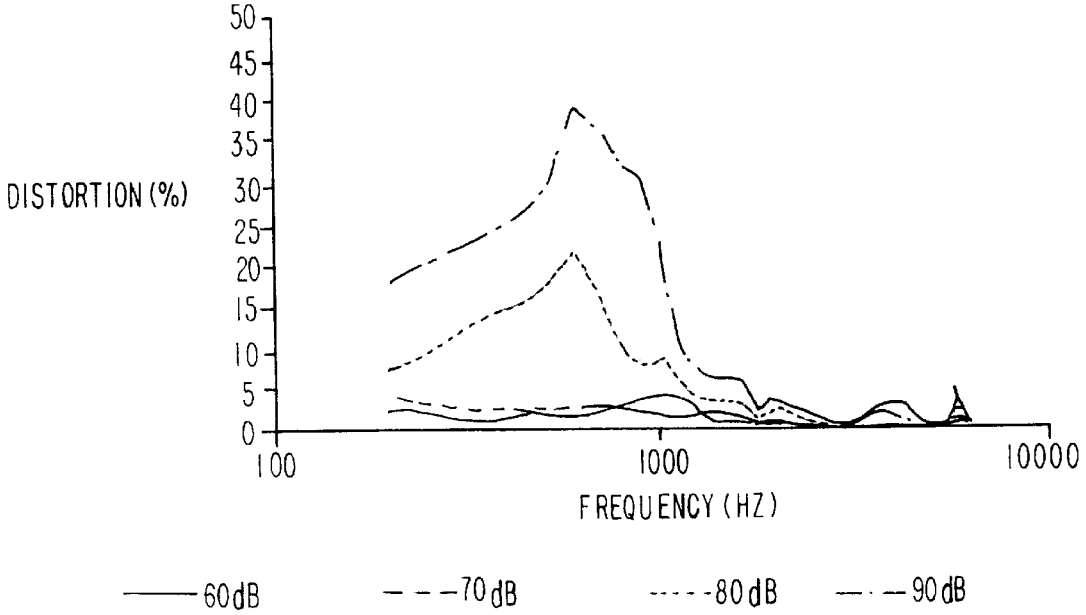
FIG. 4 is a graphical representation of the sound distortion performance characteristics in the hearing aid of FIG. 3 at different input sound levels.
Figure 3:
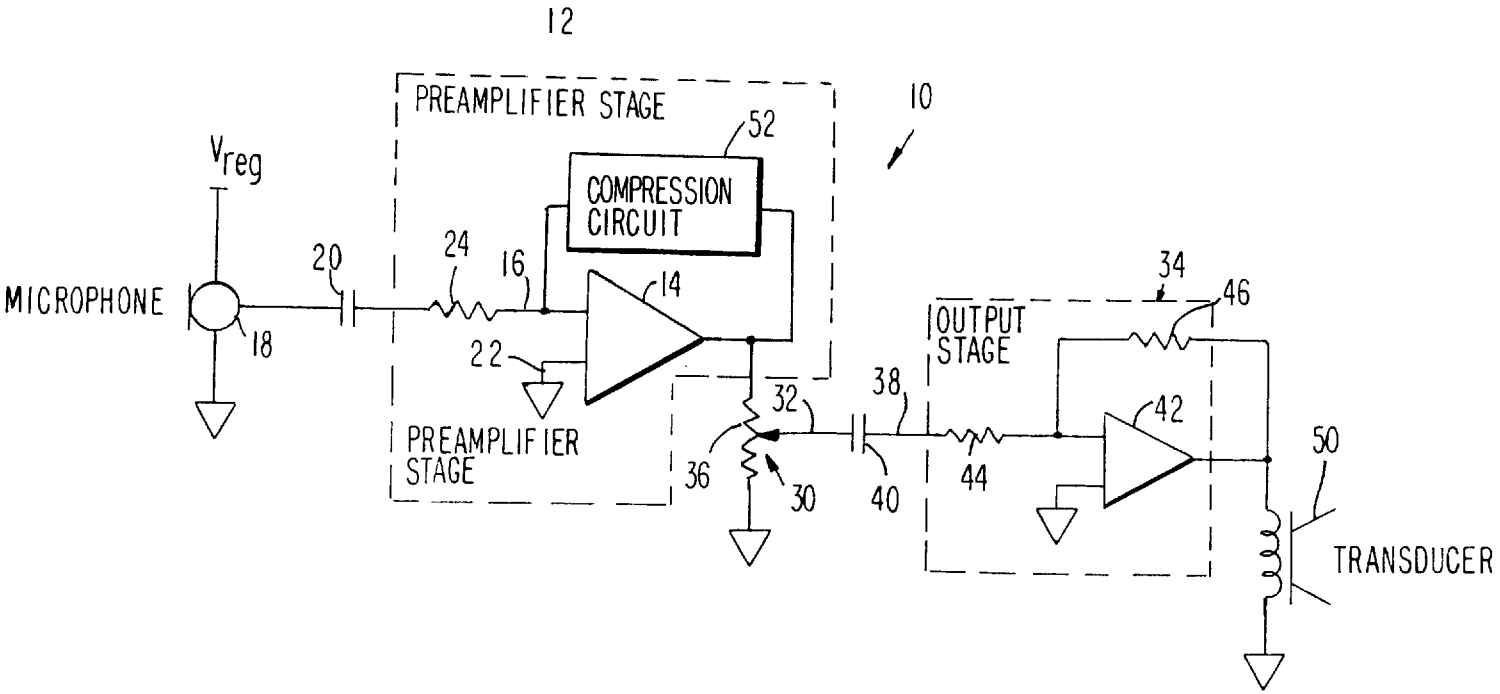
FIG. 3 (PRIOR ART)
FIG. 3 is a circuit diagram for a conventional hearing aid with compression circuitry at the preamplifier stage.
Figure 5:
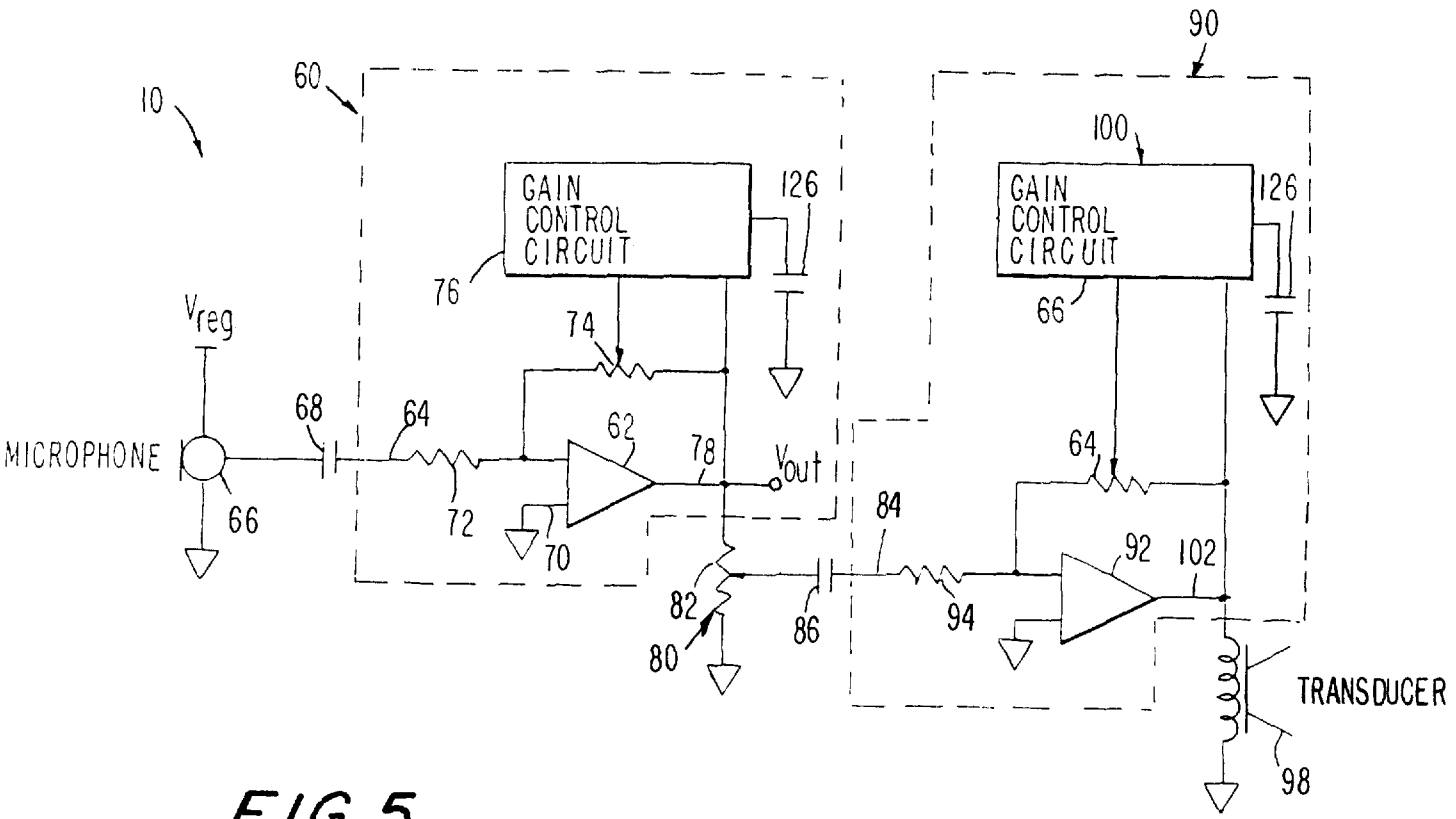
FIG. 5 is a circuit diagram for a hearing aid according to an embodiment the present invention, illustrating compression feedback loops connected to preamplifier and output stages.

Referring now to FIG. 5, one embodiment of the hearing aid circuitry for minimizing distortion according to the present invention is provided. As shown, the hearing aid 10 has a preamplifier stage 60 and an output stage 90. The preamplifier stage is provided to increase the input signal amplitude so as to improve the overall signal-to-noise ratio (SNR) of the system.

The preamplifier stage 60 includes an amplifier 62 having one input 64 connected to an input receiver, such as microphone 66, via coupling capacitor 68, and another input 70 connected to ground. The amplifier 62 has an adjustable gain set by fixed resistor 72 and variable resistor 74. Preferably, the variable resistor is a current controlled resistor responsive to a control current supplied by a gain control circuit. The current controlled resistor has a predetermined voltage-to-current transfer function (transconductance) which is directly proportional to the control current supplied by the gain control circuit. An example of a suitable current controlled resistor is a operational transconductance amplifier (OTA) model LM3080 manufactured by National Semiconductor Corporation.

The gain control circuit 76 is connected to the output 78 of amplifier 62 and to variable resistor 74. The gain control circuit 76 measures or detects the voltage of the output signal from the amplifier 62 and compares the measured voltage with a predetermined threshold voltage. Preferably, the predetermined threshold voltage is 7.8 mV(rms) input-referred. If the measured voltage is greater than the threshold voltage, then the gain control circuit 76 varies the resistance of variable resistor 74 so as to reduce the gain of the preamplifier stage amplifier 62. If the measured voltage is less than the threshold voltage then the gain control circuit generates a current that sets the variable resistor 74 for maximum gain of amplifier 62.

The gain control circuit 76, the resistor 72, the variable resistor 74, and the amplifier 62 form a preamplifier compression feedback loop which controls the gain of the amplifier 62. The preamplifier compression feedback loop is provided to reduce the gain of the preamplifier stage 60 just before the output signal of the amplifier 62 exceeds the capabilities of the supply voltage, that is, prior to amplifier saturation. Utilization of the compression feedback loop causes the preamplifier stage amplifier 62 to amplify within its linear region and thus prevents the amplifier from saturating. Hence, saturation distortion, for example, peak-clipping is limited or substantially minimized even when the input sound level is high, for example, exceeds 85 dB.

The preamplifier stage 60 is typically followed by a user adjustable volume control circuit 80 that permits a practitioner or patient to adjust the output sound level of the hearing aid 10 for maximum comfort. In the embodiment of FIG. 5, a variable resistor, such as potentiometer 82, is connected as a voltage divider to ground between an output 78 of the preamplifier stage 60 and an input 84 of the output stage 90 via coupling capacitor 86.

The output stage 90 of hearing aid 10 includes an amplifier 92 having an input connected to the output 84 of volume control circuit 80. The output stage 90 also has an adjustable gain set by fixed resistor 94 and variable resistor 96 and is provided to drive the hearing aid transducer in the form of speaker 98. Gain control circuit 100 is connected to the output 102 of amplifier 92 and to variable resistor 96. Similar to the gain control circuit for the preamplifier stage, the output stage gain control circuit 100 measures or detects the voltage of the output signal from the amplifier 92 and compares the measured voltage with a predetermined threshold voltage. Preferably, the threshold voltage is 880 mV(rms) output-referred when using a class B push-pull amplifier circuit or a class D pulse-width modulated amplifier circuit in the output stage. If the measured voltage is greater than the threshold voltage, then the gain control circuit 100 varies the resistance of variable resistor 96 so as to reduce the gain of the output stage amplifier 92. If the measured voltage is less than the threshold voltage then the gain control circuit generates a current that sets the variable resistor 96 for the maximum gain of amplifier 92.

The gain control circuit 100, the resistor 94, the variable resistor 96, and the amplifier 92 form an output stage compression feedback loop that controls the gain of the amplifier 92. The output stage compression feedback loop is provided to reduce the gain of the output stage 90 just before the output signal of the amplifier 92 exceeds the capabilities of the supply voltage, that is, prior to amplifier saturation. Utilization of the compression feedback loop causes the output stage amplifier 92 to amplify within its linear region and thus prevents the amplifier from saturating. Hence, saturation distortion, for example, peak-clipping is limited or substantially minimized even when the input sound level exceeds 85 dB.

As described above, the compression feedback loops are used to minimize the sound distortion in hearing aids, especially when the input sound level increases. In addition, the compression feedback loop provides a constant compression ratio, for example, 10:1, so as to ensure a predictable output signal amplitude from the preamplifier stage amplifier 62 and the output stage amplifier 92 for any input signal amplitude into the amplifier. As a result, numerous configurations for the compression feedback loops may be used to achieve at least these desired features.

Figure 6:
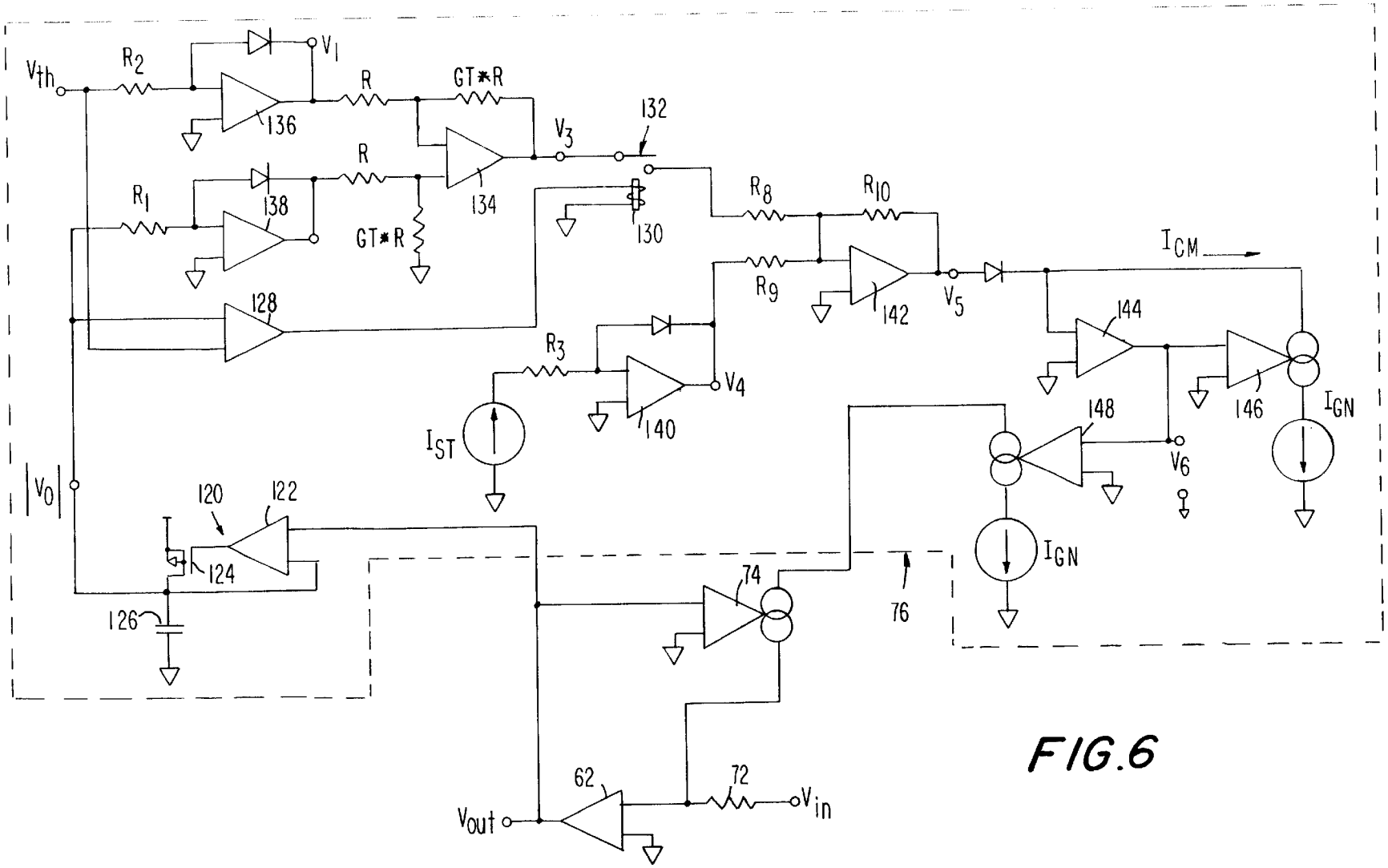
FIG. 6 is an exemplary embodiment for a compression feedback loop circuit according to the present invention, illustrating a gain control circuit connected to a preamplifier stage amplifier and a current controlled resistor.

An exemplary embodiment for the compression feedback loop is shown in FIG. 6. For simplicity, the following description will be for a compression feedback loop for the preamplifier stage, however, this compression feedback loop may also be utilized in the output stage. Further, the compression ratio for either stage may be changed by using discrete components having different characteristics and/or values.

In the embodiment of FIG. 6, the preamplifier stage amplifier output is connected to a half-wave rectifier circuit within gain control circuit 76. The half-wave rectifier circuit 120 includes amplifier 122, PMOSFET transistor 124, and capacitor 126. Although the rectifier circuit shown is a half-wave rectifier, a full-wave rectifier circuit may also be used. Further, capacitor 126 is a primary compensation element for the loop and has a value that is chosen so its delay characteristic is dominant over the time delay through the loop. The output of the rectifier circuit is fed to a comparator 128 that compares the voltage of the rectified signal with the predetermined threshold voltage. If the rectified signal voltage ($V_0$) is less than the threshold voltage ($V_{th}$) then solenoid 130 in relay switch 132 is not energized and the relay switch remains open. If the rectified signal voltage ($V_0$) is greater than the threshold voltage ($V_{th}$) then the output of the comparator 128 energizes the relay solenoid 130 and closes relay switch 132, so as to enable operation of the gain compression feature. When the relay switch is closed, amplifier 134 acts as a difference amplifier to subtract the output voltage $V_1$ of logarithmic amplifier 136 from the output voltage $V_2$ of logarithmic amplifier 138, and to scale the result by a gain transfer factor (GT). The output voltage $V_3$ of difference amplifier 134 is summed with the output voltage of logarithmic amplifier 140 by summing amplifier 142. Amplifier 144 and operational transconductance amplifier 146 form a feedback voltage-to-current converter. The output voltage $V_6$ of amplifier 144 controls operational transconductance amplifier 148 to provide the desired current to current-controlled resistor 74.

In essence, amplifiers 134 through 148 and their associated discrete components operate as a compression control signal processor that generates and provides the desired current to control the variable resistor 74. As noted above, the current controlled variable resistor 74 is preferably an operational transconductance amplifier that changes the gain of the amplifier 62 as the current increases or decreases. An example of a suitable transconductance amplifier is the model LM3080 manufactured by National Semiconductor. A more detailed description of the compression feedback loop can be found in U.S. application entitled "A GAIN COMPRESSION AMPLIFIER PROVIDING A LINEAR COMPRESSION FUNCTION", filed concurrently herewith, which is assigned to the assignee hereof and is incorporated herein in its entirety by reference.

The output increase (OI) in amplitude for the compression feedback loops, for example, the output of preamplifier stage amplifier 62 is defined by the following equation:

$$OI = 20\log_{10}\left[\frac{|V_o|}{V_{th}}\right]$$

Where:

$V_0$ is output voltage from the half wave rectifier; and $V_{th}$ is the predetermined threshold voltage.

Figure 7:
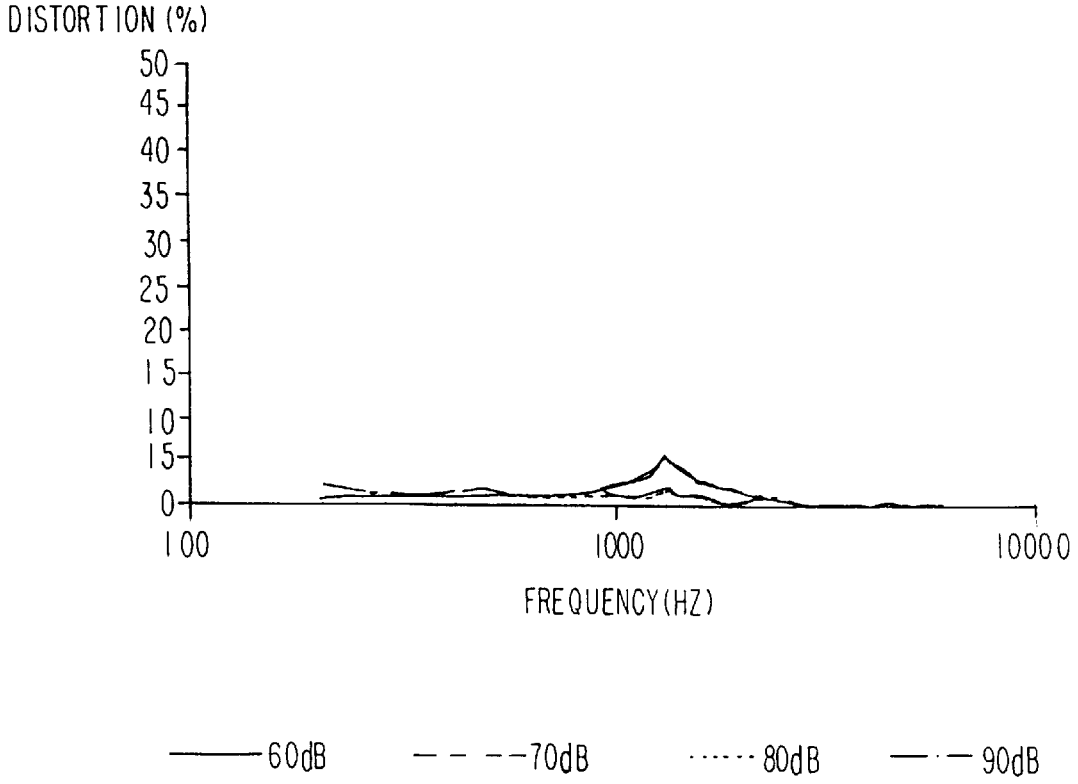
FIG. 7 is a graphical representation of the sound distortion characteristics in a hearing aid according to the present invention.
Figure 8:
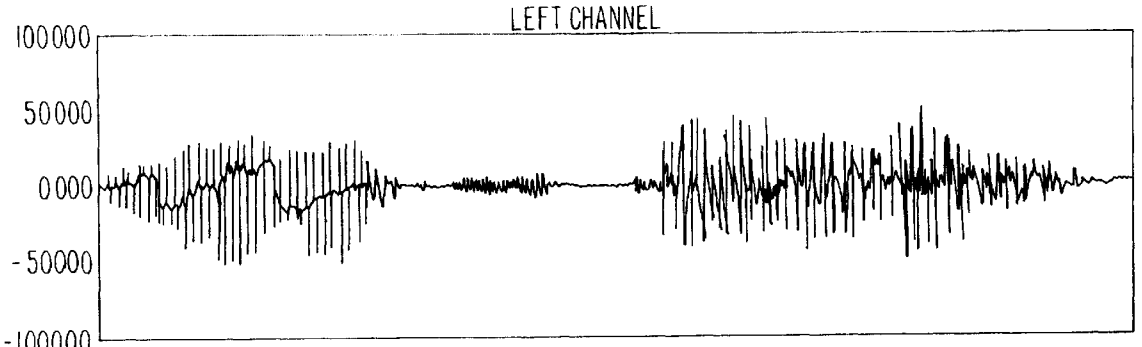
FIG. 8 is an unamplified time waveform of a test speech fragment.
Figure 9:
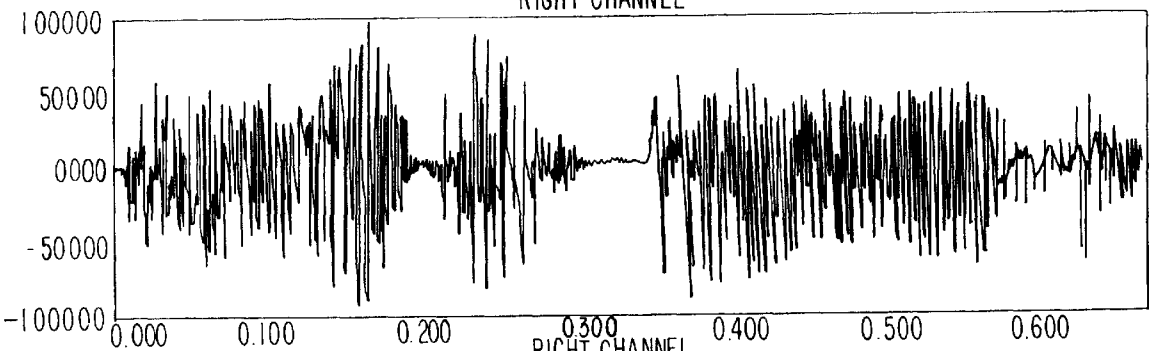
FIG. 9 is a time waveform of the speech fragment of FIG. 8 at the output of the output stage of FIG. 3.
Figure 10:
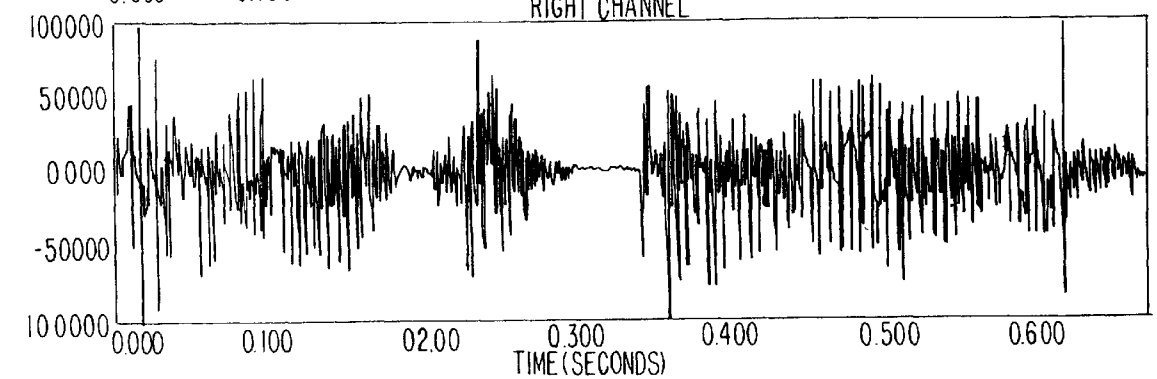
FIG. 10 is a time waveform of the speech fragment of FIG. 8 at the output of the output stage of FIG. 5.

FIG. 7 provides a graphical representation of the distortion performance characteristics for a hearing aid utilizing multiple compression feedback loops. FIGS. 8–10 provide a comparison between a test speech pattern (FIG. 8), the output speech pattern of a conventional hearing with compression at the preamplifier stage (FIG. 9), and the output speech pattern of a hearing aid with compression at the preamplifier and output stages (FIG. 10).

Figure 11:
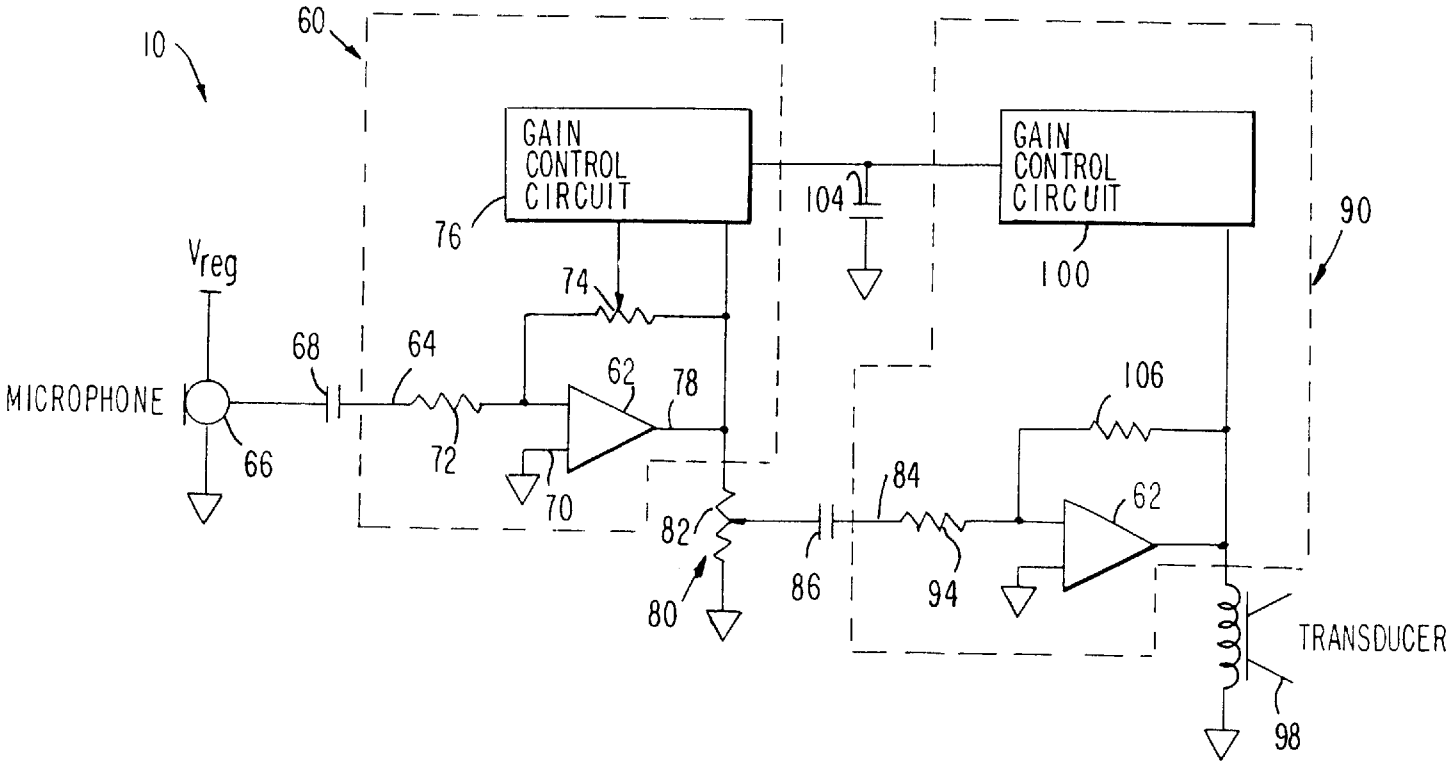
FIG. 11 is a circuit diagram for an alternative embodiment of the hearing aid circuitry according to the present invention.

Referring now to FIG. 11 an alternative embodiment of the hearing aid circuitry according to present invention is provided. In this embodiment, a single timing capacitor 104 is used for each gain control circuit 76 and 100 instead of multiple timing capacitors 126. In this alternative embodiment, the output stage 90 has a fixed gain set by resistors 94 and 106. Each stage is still independently sensed by their respective gain control circuit 76 and 100, but the amplitude of the output signal for each stage is controlled by a single gain control circuit which is preferably associated with the preamplifier stage 60. The compression ratio for this configuration is also high, for example, 10 to 1 (10:1), thus causing one stage to dominate the compression action depending on the attenuation of the volume control circuit 80.

Referring again to FIG. 5, in operation the input sound level, whether it be soft speech, conversational speech, loud speech and shouted speech is detected by the microphone 66 and filtered and amplified by the preamplifier stage 60. The amplified signal from the preamplifier stage passes through the volume control circuitry where it may be attenuated depending upon the setting of potentiometer 82. The output of the volume control circuit is transferred to the output stage 90 for amplification. The output stage amplifies the signal and drives the transducer, such as speaker 98.

As the input sound level is amplified, the gain control circuit 76 senses or measures the voltage of the output signal of the amplifier 62. If the voltage of the amplifier output signal exceeds the predefined threshold voltage, preferably 7.8 mV(rms) input-referred, the gain of the amplifier 62 is automatically decreased by adjusting the resistance of variable resistor 74. As the output voltage of the amplifier attempts to increase beyond the predetermined threshold voltage, the resistance of the variable resistor 74 is adjusted so that the amplifier continues to operate in the linear region and thus inhibits the amplifier 62 from saturating.

Similarly, the output voltage of the output stage amplifier 92 is sensed or measured by gain control circuit 100. If the voltage of the amplifier output exceeds the predefined threshold voltage, preferably 880 mV(rms) output-referred, the gain of the amplifier is automatically decreased by adjusting the resistance of variable resistor 96. As the output voltage of the amplifier attempts to increase beyond the predetermined threshold voltage, the resistance of the variable resistor 74 is adjusted so that the amplifier continues to operate in the linear region and thus inhibits the amplifier 92 from saturating.

It will be understood that various modifications can be made to the embodiments of the present invention herein disclosed without departing from the spirit and scope thereof. For example, various types of amplifiers configurations may be utilized in the preamplifier and the output amplifier stages. Therefore, the above description should not be construed as limiting the invention but merely as exemplifications of preferred embodiments thereof. Those skilled in the art will envision other modifications within the scope and spirit of the present invention as defined by the claims appended hereto.

What is claimed is:

1. A non-distorting hearing aid for amplifying sounds over a wide dynamic range, the hearing aid comprising:

a microphone for converting the sounds into an audio signal;

a preamplifier connected to the microphone, the preamplifier including:

a first operational amplifier, an output of the first operational amplifier forming an output of the preamplifier;

a first input resistance for receiving the audio signal and for establishing a current flowing into an input of the first operational amplifier; and a first variable resistance for conducting a current from the output of the first operational amplifier to the input of the first operational amplifier, a value of the first variable resistor being dependant on a voltage at the output of the preamplifier, wherein the gain of the preamplifier is proportional to a ratio of the first input resistance and the first variable resistance and wherein, when the voltage at the output of the first operational amplifier reaches a first predetermined threshold, the gain of the preamplifier is reduced so that the output of the first operational amplifier remains below a first predetermined voltage; and an output amplifier connected to the output of the preamplifier, the output amplifier including:

a second operational amplifier, an output of the second operational amplifier forming an output of the output amplifier;

a second input resistance for receiving the output signal from the preamplifier and for establishing a current flowing into an input of the second operational amplifier; and a second variable resistor for conducting a current from the output of the second operational amplifier to the input of the second operational amplifier, a value of the second variable resistor being dependant on a voltage at the output of the second operational amplifier, wherein the gain of the output amplifier is proportional to a ratio of the second input resistance and the second variable resistance and wherein, when the voltage at the output of the second operational amplifier reaches a second predetermined threshold, the gain of the output amplifier is reduced so that the output of the second operational amplifier remains below a second predetermined voltage.

2. The hearing aid according to claim 1 wherein the first and second predetermined voltages are less than a supply voltage for the first and second operational amplifiers.

3. The hearing aid according to claim 1 wherein the first and second variable resistors are operational transconductance amplifiers.

* * * * *